US007530534B2

(12) United States Patent
Oldewurtel

(10) Patent No.: US 7,530,534 B2
(45) Date of Patent: May 12, 2009

(54) METHOD FOR SETTING AN OUTPUT VOLTAGE OF A RECEIVING CIRCUIT OF A RECEIVING HEAD OF A RAIL CONTACT AND RAIL CONTACT SYSTEM

(75) Inventor: Kassen Oldewurtel, Markgröningen (DE)

(73) Assignee: Alcatel, Paris (FR)

( * ) Notice: Subject to any disclaimer, the term of this patent is extended or adjusted under 35 U.S.C. 154(b) by 582 days.

(21) Appl. No.: 11/300,471

(22) Filed: Dec. 15, 2005

(65) Prior Publication Data

US 2006/0170493 A1 Aug. 3, 2006

(30) Foreign Application Priority Data

Jan. 31, 2005 (EP) ..... 05290217

(51) Int. Cl.
*B61L 13/00* (2006.01)

(52) U.S. Cl. ..... 246/247; 246/249; 246/122 R; 324/224

(58) Field of Classification Search ..... 246/245, 246/247, 249, 178, 192 R, 193, 194, 195, 246/201, 202; 191/10 R, 45 R; 324/224, 324/225; 340/561, 941

See application file for complete search history.

(56) References Cited

U.S. PATENT DOCUMENTS

| | | | | | |
|---|---|---|---|---|---|
| 2,966,582 | A | * | 12/1960 | Wachtel | 246/249 |
| 3,721,821 | A | * | 3/1973 | Blanyer | 246/249 |
| 3,752,426 | A | * | 8/1973 | Pal | 246/249 |
| 4,469,298 | A | * | 9/1984 | Uebel | 246/249 |
| 4,787,581 | A | * | 11/1988 | Dobler et al. | 246/247 |
| 5,333,820 | A | * | 8/1994 | Gilcher | 246/249 |
| 6,663,053 | B1 | * | 12/2003 | Shams | 246/249 |

FOREIGN PATENT DOCUMENTS

| | | | |
|---|---|---|---|
| DE | 3302883 A1 | | 8/1984 |
| DE | 91 12 156.6 U1 | | 12/1991 |
| EP | 1468891 | * | 10/2004 |
| EP | 1541440 | * | 6/2008 |

* cited by examiner

*Primary Examiner*—Mark T Le
(74) *Attorney, Agent, or Firm*—Sughrue Mion, PLLC

(57) ABSTRACT

A method is proposed for setting an output voltage of a receiving circuit (5) of a receiving head (4) of a rail contact and a rail contact system for executing the method, at least one receiving voltage tapped from the receiving head (4) of the rail contact being superposed by at least one adjustment voltage to produce the output voltage. The adjustment voltage is tapped by a transformer circuit (20) from a transmitting circuit (2) of the rail contact as a voltage proportional to an electric current flowing in a transmitting coil (7) of the rail contact.

11 Claims, 1 Drawing Sheet

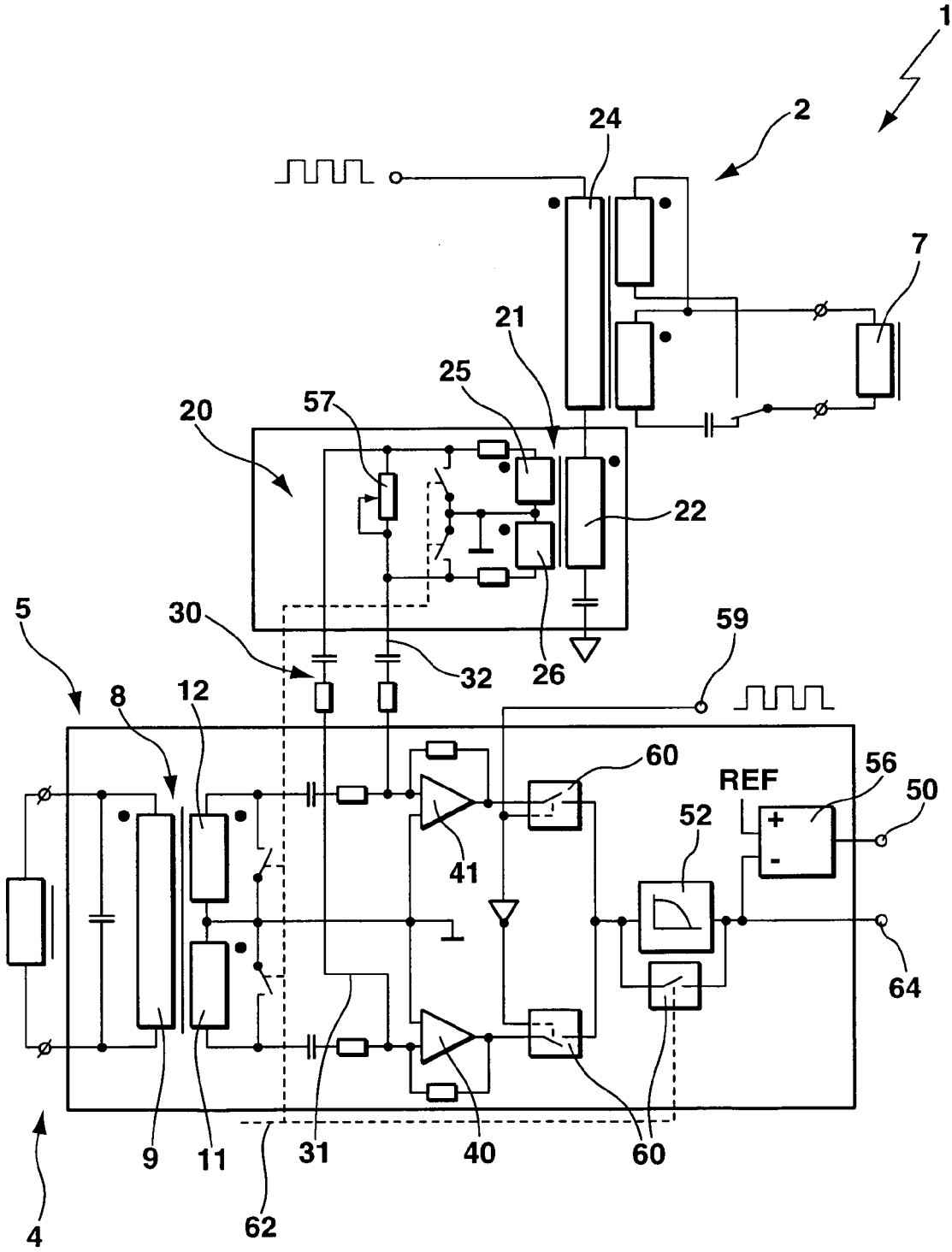
1
2
24
7
21
25
20
57
22
26
5
30
32
59
8
12
60
REF
56
50
52
41
64
9
11
31
40
60
4
62

METHOD FOR SETTING AN OUTPUT VOLTAGE OF A RECEIVING CIRCUIT OF A RECEIVING HEAD OF A RAIL CONTACT AND RAIL CONTACT SYSTEM

The invention is based o a priority application EP 05290217.8 which is hereby incorporated by reference.

FIELD OF THE INVENTION

The invention relates to a method for setting an output voltage (adjustment) of a receiving circuit of a receiving head of a rail contact, wherein to generate the output voltage at least one receiving voltage tapped from the receiving head of the rail contact is superposed by at least one adjustment voltage, and to a rail contact system for executing the method. The method is suitable in particular for use in axle counting points (axle counters) of rail contacts.

BACKGROUND OF THE INVENTION

In railway signaling, axle counters are used among other things to monitor track sections. Each axle counter contains counting points with two rail contacts and one or more evaluation units.

Each axle counter monitors a track section assigned to it. If the axle counter detects a rail vehicle passing, the track section is switched to occupied. If the next axle counter in the direction of travel of the rail vehicle detects the passing rail vehicle, the track section is switched to free again (track release).

When a vehicle wheel passes over, two adjacent rail contacts are actuated one after another and two pulses that overlap in time are triggered. These pulses are evaluated in the evaluation unit with regard to their amplitude and are converted into counting pulses, the sequence of pulses produced by the direction of travel of the passing vehicle axles determining the respective counting direction of the pulses.

Electronic rail contacts often comprise two transmitting heads with transmitting coils mounted on a rail and lying spatially one behind the other, which heads are supplied with audio-frequency alternating currents, and two receiving coils of receiving heads arranged on the respectively opposite rail side and coupled inductively to the transmitting coils. One transmitting and one receiving coil respectively together form a pulse generator. The voltages induced in the receiving coils are supplied to an evaluation unit with a receiving circuit arranged in the vicinity of the rail contact and evaluated there. The temporary drop and the phase rotation of the voltages induced in the receiving coils are evaluated as an indication of the passing of a vehicle wheel at a rail contact. The drop and the phase rotation of the receiving voltages are determined by the coupling between the transmitting and receiving coils when a vehicle wheel passes. The voltages induced in the receiving coils are converted via an output voltage of the receiving circuit generated in the receiving circuit into digital signals, from which counting pulses dependent on the direction of travel are finally derived.

It is a prerequisite for proper operation of the axle counting systems controlled by the electronic rail contacts that the output voltages sent by the receiving coils to the evaluation unit and determined from the receiving voltages are not also dependent in the amplitudes on parameters that have nothing to do with the influence of the vehicle wheels. Such influences can for example be due to temperature variations in the transmitting coil and thus to a temperature-dependent receiving voltage. Furthermore, the output voltage must lie in predetermined value ranges, so that the evaluation unit can evaluate the output voltage correctly. The receiving voltage induced in the receiving coil, however, is determined strongly by the magnetic properties of the surroundings of the axle counter. If the place of use of the axle counter is e.g. on a railway bridge made of ferrous metals, the receiving voltage is substantially greater than in the case of a place of use in a track area with a track bed of gravel. The receiving voltage can vary by several 100% due to such influencing factors.

To keep the output voltage in the predetermined value range, an adjustment of the receiving voltage is undertaken. This adjustment can be carried out e.g. mechanically, the mechanical construction of the axle counter being varied in such a way that the receiving voltage corresponds to a desired value. An electrical adjustment can also be carried out. This is safer and more convenient on account of the fact that no work on the track is necessary for this. Furthermore, in the case of an electrical adjustment the mechanical construction of the axle counter can be simpler, sturdier and cheaper due to the elimination of the adjustment console. In an electrical adjustment according to the prior art, an electric current, which is obtained from a digital signal and is in phase opposition to the electric current flowing through the transmitting coil, is injected into a branch of the receiving circuit. An adjustment voltage corresponding to the current in phase opposition is thereby taken from the receiving voltage, so that when a wheel passes through, a change of sign of the output voltage occurs, which is interpreted as a wheel counting pulse. The receiving circuit has a current sensor transformer, which taps the receiving voltage via its primary winding from an oscillating circuit of the receiving head. The current sensor transformer has two secondary windings, via which a first partial receiving voltage and a second partial receiving voltage of opposing polarity to the first partial receiving voltage are generated in a branch respectively of the receiving circuit. These two partial receiving voltages are superposed via a differential amplifier circuit, e.g. the formation of a difference takes place. The electrical adjustment is carried out such that if no vehicle wheel passes an output voltage of e.g. 200 mV is supplied. If a vehicle wheel passes the rail contact, a current in phase opposition is induced in the receiving head, or its receiving coil. The then resulting output voltage is then minus 200 mV. This voltage change is registered in the evaluation unit as a wheel passing.

The electric current obtained from the digital signal and injected into at least one of the branches, and the corresponding adjustment voltage superposed with the partial receiving voltages is, seen in itself, temperature-stable. Due to the injection in phase opposition, this constant current is deducted from the temperature-dependent input signal of the receiving circuit, i.e. from the temperature-dependent partial receiving voltages. The resulting difference, i.e. the resulting output voltage of the receiving circuit, is then assigned a markedly higher temperature coefficient than an output voltage that is not electrically adjusted.

A strong temperature dependence of the output voltage of the receiving circuit thus adjusted results from this. This strong temperature dependence prevents a general usage of this electrical adjustment.

Temperature variations in the transmitting coil can have a negative effect on the mode of operation of the rail contacts. This can be the case in particular if the transmitting power, due to an electric current flowing through the transmitting coil that is dependent on the temperature of the transmitting coil, is subject to uncontrolled variations. The adjusted output voltage can in this case vary in such a sharply temperature-dependent manner that any evaluation by the evaluation unit is no longer possible. Considerable safety problems can arise from this when using the rail contacts in railway operation due to incorrect assessment of the receiving signal of the receiving coil.

OBJECT OF THE INVENTION

The object of the invention is to supply a method for setting an output voltage of a receiving circuit of a receiving head of a rail contact and a rail contact system for executing the method that avoid the disadvantages of the prior art, in particular that reduce the temperature-dependent behaviour of the rail contact.

SUMMARY OF THE INVENTION

In the method according to the invention for setting an output voltage of a receiving circuit of a receiving head of a rail contact, at least one receiving voltage tapped from the receiving head of the rail contact is superposed by at least one adjustment voltage to generate the output voltage. According to the invention, the adjustment voltage is tapped by means of a transformer circuit from a transmitting circuit of the rail contact as a voltage proportional to an electric current flowing in a transmitting coil of the rail contact.

A current corresponding to the adjustment voltage, which current is injected for this purpose into the receiving circuit, has in the case, since an excessive receiving voltage is to be balanced by the adjustment, a phase that is in opposition to the electric current flowing in the transmitting coil of the rail contact, which corresponds to the current and voltage conditions in the receiving coil of the receiving head when a wheel passes.

For the electrical adjustment according to the invention, therefore, an electric current in phase opposition to the electric current flowing through the transmitting coil of the transmitting head, which current in phase opposition is obtained through the transformer circuit e.g. from the current of an amplifier end stage of the transmitting circuit, is injected into the receiving circuit. This injected current in phase opposition is thus directly proportional to the electric current flowing through the transmitting coil. Both currents have the same temperature coefficient, i.e. the same temperature dependence in the amplitude. When forming the difference in the currents, or superposing the corresponding voltages, no additional temperature dependence of the output voltage of the receiving circuit thus arises. This results in a better adjustability of axle counters.

The electrical adjustment according to the invention can be used generally. No additional temperature drifts occur. Any mechanical adjustment can be dispensed with. Only a transformer circuit, which requires very little outlay on apparatus, is used.

The method according to the invention facilitates a temperature-stable electrical adjustment for axle counters.

It is particularly preferred in the method according to the invention for a first partial adjustment voltage and a second partial adjustment voltage of opposing polarity to the first partial adjustment voltage to be tapped from the transmitting circuit preferably by means of a current sensor transformer. According to the known receiving circuits, a first partial receiving voltage and a second partial receiving voltage of opposing polarity to the first partial receiving voltage are tapped from the receiving head, preferably by means of a transformer. Thus a partial adjustment voltage is superposed in each case with a partial receiving voltage to give a partial output voltage and the partial output voltages are, preferably following amplification in each case, superposed to give the output voltage. This preferred variant of the method according to the invention is suitable for use in known receiving circuits of receiving heads of rail contacts.

Particularly advantageously a voltage ratio of the values, i.e. of a maximum amplitude, of the partial adjustment voltages to the values of the partial receiving voltages is set, preferably by means of a potentiometer. A very large range of receiving voltages can thereby by balanced flexibly such that the output voltage lies in the desired value range and the transformer circuit does not have to be adapted structurally to the respective conditions of use.

In a rail contact system according to the invention with a rail contact, which has a transmitting head with a transmitting circuit and a receiving head with a receiving circuit, the receiving circuit is disposed to generate an output voltage by superposition of at least one receiving voltage tapped from the receiving head by at least one adjustment voltage. According to the invention a transformer circuit is provided, the transformer circuit being disposed to tap the adjustment voltage from the transmitting circuit as a voltage proportional to an electric current flowing in a transmitting coil of the rail contact. The rail contact system according to the invention is disposed to execute the method according to the invention and therefore makes the advantages of this method available.

In a preferred embodiment of the rail contact system according to the invention, the receiving circuit has a transformer, the transformer being disposed to tap a first partial receiving voltage and a second partial receiving voltage of opposing polarity to the first partial receiving voltage as receiving voltages from the receiving head. These features of the receiving circuit correspond to those of known receiving circuits. The transformer circuit provided according to the invention has in this embodiment a current sensor transformer, the current sensor transformer being disposed to tap a first partial adjustment voltage and a second partial adjustment voltage of opposing polarity to the first partial adjustment voltage from the transmitting circuit as adjustment voltages. The transformer circuit is connected in this case by means of a connecting circuit to the receiving circuit and the connecting circuit is disposed to superpose a partial adjustment voltage in each case with a partial receiving voltage to give a partial output voltage. Furthermore, the receiving circuit is disposed to superpose the partial output voltages to give the output voltage. This preferred embodiment is thus executed such that the two partial adjustment voltages, or corresponding currents, are injected into the differential amplifier circuit of a known receiving circuit of a receiving head.

If the receiving circuit has two amplifier elements, one of the amplifier elements respectively being disposed to amplify one of the partial output voltages, then the output voltage can be kept reliably within a desired voltage interval.

It is particularly preferred if the transformer circuit has a potentiometer, a voltage ratio of the values of the partial adjustment voltages to the values of the partial receiving voltages being able to be set by means of the potentiometer. This potentiometer facilitates a flexible adjustment in a wide receiving voltage range.

The rail contact system according to the invention is preferably used as an axle counter. This increases safety in rail transport substantially.

Further features and advantages of the invention result from the following description of a practical example of the invention, with reference to the figures of the drawing, which show details substantial to the invention, and from the claims.

The individual features can each be realized individually or severally in any combination in a variant of the invention.

BRIEF DESCRIPTION OF THE DRAWING

A practical example of the device according to the invention is shown in the schematic drawing and is explained in the following description.

The drawing shows a circuit diagram of a rail contact system according to the invention.

DETAILED DESCRIPTION OF THE INVENTION

The drawing shows a rail contact system according to the invention in a strongly schematic form in a circuit diagram. The rail contact system is disposed to execute the method according to the invention. It has a rail contact, which has a transmitting head 1 with a transmitting circuit 2 and a receiving head 4 with a receiving circuit 5. The transmitting circuit 2 or the transmitting coil 7 of the transmitting head 1 is excited by a transmission signal with a frequency of 30 kilohertz. The receiving circuit 5 is disposed to generate an output voltage from two receiving voltages tapped from the receiving head by superposing them with two adjustment voltages. The receiving circuit 5 has a transformer 8. The transformer 8 is disposed to tap a first partial receiving voltage and a second partial receiving voltage of opposing polarity to the first partial receiving voltage as receiving voltages from the receiving head 4. The receiving voltage is tapped from an oscillating circuit of the receiving head 4 via a primary winding 9 of the transformer 8. The transformer 8 has two secondary windings 11, 12, via which the first partial receiving voltage and the second partial receiving voltage of opposing polarity to the first partial receiving voltage are generated respectively in a branch of the receiving circuit 5. This corresponds to a receiving circuit of a rail contact according to the prior art. According to the invention, a transformer circuit 20 is provided, the transformer circuit 20 being disposed to tap the adjustment voltages from the transmitting circuit 2 as voltages proportional to an electric current flowing in a transmitting coil 7 of the rail contact. To this end the transformer circuit 20 has a current sensor transformer 21. The current sensor transformer 21 is disposed to tap a first partial adjustment voltage and a second partial adjustment voltage of opposing polarity to the first partial adjustment voltage from the transmitting circuit 2 as adjustment voltages. This current sensor transformer 21 comprises a primary winding 22, through which a current flows that also flows through an exciter coil 24 of an amplifier end stage of the transmitting circuit 2. To generate a current in phase opposition to the current flowing through the transmitting coil 7, the primary winding 22 is wound oppositely to the exciter coil 24. The current sensor transformer 21 also has two secondary windings 25, 26. One of the partial adjustment voltages is induced in each of the secondary windings 25, 26. The transformer circuit 20 is connected by means of a connecting circuit 30 to the receiving circuit 5. The connecting circuit 30 is disposed to superpose a partial adjustment voltage in each case with a partial receiving voltage to give a partial output voltage. The connecting circuit 30 comprises two branches 31, 32 each with a capacitor and an ohmic resistor, one of the partial output voltages respectively being connected via one of the branches 31, 32 to the receiving circuit 5. The receiving circuit 5 is formed as a differential amplifier. For this purpose the receiving circuit 5 has two amplifier elements 40, 41, one of the amplifier elements 40, 41 in each case being disposed to amplify one of the partial output voltages. Furthermore, the receiving circuit 5 is disposed to superpose the partial output voltages to give the output voltage. The latter is achieved in that the outputs of the amplifier elements 40, 41 are connected together. This output voltage is made available to a wheel pulse generator connection 50. Connected between the wheel pulse generator connection 50 and the differential amplifier circuit is also a low pass 52 with a limit frequency of 70 hertz and a comparator 54. The comparator 54 operates, e.g., with a threshold voltage of 25 mV.

A potentiometer 57 in the transformer circuit 20 is connected such that a voltage ratio of the values of the partial adjustment voltages to the values of the partial receiving voltages can be set. By means of this potentiometer 57 the receiving circuit 5 shown can be balanced using adjustment voltages of variable amplitude. Furthermore, the receiving circuit 5 shown has the option of an electrical adjustment according to the prior art. To do this, an electric current obtained from a digital signal can be injected into the branches of the differential amplifier, or a corresponding adjustment voltage superposed with the partial receiving voltages. To do this, a digital signal connection 59 is provided, which can be connected via switch 60. The digital signal has a frequency of 30 kilohertz corresponding to the transmitting signal and has e.g. a maximum amplitude of plus/minus 5 volts.

The overall circuit according to the invention has a self-test option. A connection 62 for a self-test permits the switching of various self-test switches. A signal at an additional measuring signal output 64 can e.g. be verified in such a self-test.

A method is proposed for setting an output voltage of a receiving circuit (5) of a receiving head (4) of a rail contact and a rail contact system for executing the method, at least one receiving voltage tapped from the receiving head (4) of the rail contact being superposed by at least one adjustment voltage to generate the output voltage. The adjustment voltage is tapped by means of a transformer circuit (20) from a transmitting circuit (2) of the rail contact as a voltage proportional to an electric current flowing in the transmitting coil (7) of the rail contact.

The invention is not restricted to the practical example indicated above. On the contrary, a number of variants are conceivable that make use of the features of the invention even in an execution of a fundamentally different nature.

The invention claimed is:

1. A method for setting an output voltage of a receiving circuit of a receiving head of a rail contact comprising the steps of generating an output voltage by superposing at least one receiving voltage tapped from the receiving head of the rail contact with at least one adjustment voltage, wherein the adjustment voltage is tapped by means of a transformer circuit from a transmitting circuit of the rail contact as a voltage proportional to an electric current flowing in a transmitting coil of the rail contact.

2. A method according to claim 1, wherein a first partial adjustment voltage and a second partial adjustment voltage of opposing polarity to the first partial adjustment voltage are tapped from the transmitting circuit as adjustment voltages, and a first partial receiving voltage and a second partial receiving voltage of opposing polarity to the first partial receiving voltage are tapped from the receiving head as receiving voltages, a partial adjustment voltage being superposed in each case with a partial receiving voltage to give a partial output voltage and the partial output voltages being superposed to give the output voltage.

3. A method according to claim 2, further comprising the step of setting a voltage ratio of values of the partial adjustment voltages to values of the partial receiving voltages.

4. A method according to claim 2, wherein said adjustment voltages are tapped by means of a current sensor transformer.

5. A method according to claim 2, wherein said receiving voltages are tapped by means of a transformer.

6. A method according to claim 2, wherein said output voltages are superposed following amplification.

7. A method according to claim 3, wherein said voltage ratio is set by means of a potentiometer.

8. A rail contact system comprising a rail contact, which has a transmitting head with a transmitting circuit and a receiving head with a receiving circuit, the receiving circuit being disposed to superpose at least one receiving voltage tapped from the receiving head with at least one adjustment voltage to generate an output voltage further comprising a transformer circuit disposed to tap the adjustment voltage from the transmitting circuit as a voltage proportional to an electric current flowing in a transmitting coil of the rail contact.

9. A rail contact system according to claim 8, wherein the receiving circuit has a transformer, the transformer being disposed to tap a first partial receiving voltage and a second partial receiving voltage of opposing polarity to the first partial receiving voltage from the receiving head as receiving voltages, and the transformer circuit having a further current sensor transformer, the further current sensor transformer being disposed to tap a first partial adjustment voltage and a second partial adjustment voltage of opposing polarity to the first partial adjustment voltage from the transmitting circuit as adjustment voltages, the transformer circuit being connected by means of a connecting circuit to the receiving circuit and the connecting circuit being disposed to superpose a partial adjustment voltage in each case with a partial receiving voltage to give a partial output voltage and the receiving circuit being disposed to superpose the partial output voltages to give the output voltage.

10. A rail contact system according to claim 9, wherein the receiving circuit has two amplifier elements, each of the amplifier elements being disposed respectively to amplify one of the partial output voltages.

11. A rail contact system according to claim 9, wherein the transformer circuit has a potentiometer, a voltage ratio of the values of the partial adjustment voltages to the-values of the partial receiving voltages being able to be set by means of the potentiometer.

* * * * *

UNITED STATES PATENT AND TRADEMARK OFFICE

CERTIFICATE OF CORRECTION

PATENT NO. : 7,530,534 B2
APPLICATION NO. : 11/300471
DATED : May 12, 2009
INVENTOR(S) : Kassen Oldewurtel It is certified that error appears in the above-identified patent and that said Letters Patent is hereby corrected as shown below:

Title Page,
Item (73) Assignee: Delete "Alcatel (Assignment to Thales Pending)" and insert --Alcatel--.

Signed and Sealed this

Fifteenth Day of December, 2009

David J. Kappos

David J. Kappos
*Director of the United States Patent and Trademark Office*